US006898953B1

(12) United States Patent
Paprocki et al.

(10) Patent No.: US 6,898,953 B1
(45) Date of Patent: May 31, 2005

(54) LOCKING GATE LATCH

(75) Inventors: Benjamin J. Paprocki, West Allis, WI (US); Mark J. Knudson, East Troy, WI (US); David M. Raschka, Waukesha, WI (US)

(73) Assignee: Modern Fence Technologies, Inc., East Troy, WI (US)

( * ) Notice: Subject to any disclaimer, the term of this patent is extended or adjusted under 35 U.S.C. 154(b) by 77 days.

(21) Appl. No.: 10/430,450

(22) Filed: May 6, 2003

(51) Int. Cl.[7] ..... E05B 63/00; E05B 65/06
(52) U.S. Cl. ..... 70/106; 292/341.17; 292/285
(58) Field of Search ..... 70/106, 105, 136; 292/341.15, 341.17, 340, 236, DIG. 29, 203, 292/209, 210, 304, 134, 285

(56) References Cited

U.S. PATENT DOCUMENTS 2,794,663 A * 6/1957 Grodt et al. ..... 292/67
4,014,192 A * 3/1977 Dillon et al. ..... 70/77
4,133,337 A * 1/1979 Shea ..... 70/77
5,529,369 A * 6/1996 Welborn ..... 296/146.1
5,622,395 A * 4/1997 Shine et al. ..... 292/125
5,716,085 A * 2/1998 Kobayashi ..... 292/340
5,816,630 A * 10/1998 Bennett et al. ..... 292/341.17
6,058,747 A * 5/2000 Doyle et al. ..... 70/137

* cited by examiner

*Primary Examiner*—John B. Walsh
(74) *Attorney, Agent, or Firm*—Donald J. Ersler

(57) ABSTRACT

A locking gate latch includes a latch assembly and a striker bar. The striker bar is attached to a gate frame and the latch assembly is attached to a gate post. The latch assembly includes a latch frame, a lock latch, a locking plate and a locking tongue. The lock latch is pivotally retained by one leg of the latch frame. The locking plate is pivotally retained by the other leg of the latch frame. One end of the locking tongue is attached to an outside key lock and the other end is received by the locking plate. Pivoting the outside key lock to one side locks the locking gate latch. Pivoting the outside key lock to the other side unlocks the locking gate latch. A second embodiment of the gate latch further includes an inside locking assembly, which allows a gate to be locked from an inside.

18 Claims, 6 Drawing Sheets

LOCKING GATE LATCH

BACKGROUND OF THE INVENTION

1. Field of the Invention

The present invention relates generally to latches and more specifically to a locking gate latch, which may be used to lock a gate from an outside and an inside of the fence.

2. Discussion of the Prior Art

It appears that no locking gate latch exists, which may be used to lock a gate from an outside and an inside of the fence, yet is fabricated from a durable material. Further, it appears that existing locking gate latches require a large portion of a gate post to be removed for installation of the gate latch. It also appears that no locking gate latch exists, which fits on different size gate posts.

Accordingly, there is a clearly felt need in the art for a locking gate latch, which allows a gate to be locked from an outside as well as an inside of a fence, may be installed by cutting less area of a gate post and comes in one size that may be used for installation on different size gate posts.

SUMMARY OF THE INVENTION

The present invention provides a locking gate latch, which comes in one size that may be used for installation on different size gate posts. The locking gate latch includes a latch assembly and a striker bar. The striker bar is attached to a gate frame and the latch assembly is attached to a gate post. The striker bar includes a mounting plate and a latch bar extending from the mounting plate. The latch assembly includes a latch frame, a lock latch, a locking plate and a locking tongue. The latch frame is an "L" shaped plate that is mountable to the gate post. The lock latch is pivotally retained on one leg of the latch frame. The locking plate is pivotally attached to the other leg of the latch frame. A lock slot is formed in substantially a middle of the lock latch. The lock slot is sized to receive the locking plate.

A projection opening is formed through a top of the locking plate. One end of the locking tongue is rigidly attached to an end of an outside key lock and a tongue projection is formed on the other end of the locking tongue. The projection opening is sized to receive the tongue projection. Pivoting the outside key lock to one side pushes the locking plate into the lock slot and thus locks the lock latch. Pivoting the outside key lock to the other side removes the locking plate from the lock slot and thus unlocks the lock latch. A lock bar slot is formed on one end of the lock latch. A bar retaining slot is formed in the latch frame. The lock bar slot and the bar retaining slot are sized to slidably receive the latch bar of the striker bar.

A second embodiment of the locking gate latch further includes an inside locking assembly, which allows a gate to be locked from an inside of the fence. The latch assembly allows a gate to be locked from an outside of the fence. The inside locking assembly includes a lock frame, an inside key lock and an inside locking tongue. One end of the inside locking tongue is attached to an end of the inside key lock. The projection opening is sized to receive the other end of the inside locking tongue. Pivoting the inside key lock to one side pushes the locking plate into the lock slot and thus locks the lock latch. Pivoting the inside key lock to the other side removes the locking plate from the lock slot and thus unlocks the lock latch.

The locking gate latch is preferably installed in the following manner. The gate post must be of rectangular tubular construction for installation of the latch assembly.

An outside lock opening is formed through a front wall of the gate post to receive the locking tongue. A locking plate opening is formed through a side wall of the gate post to receive the locking plate. At least two fasteners are used to attach the latch assembly to the gate post. At least two fasteners are used to attach the striker bar to the gate frame. An inside lock opening is formed through a rear wall of the gate post to receive the rear locking tongue. At least two fasteners are used to attach the inside locking assembly to the gate post.

Accordingly, it is an object of the present invention to provide a locking gate latch, which enables a gate to be locked from an outside and an inside of a fence.

It is a further object of the present invention to provide a locking gate latch, which may be installed by cutting less area in a gate post.

Finally, it is another object of the present invention to provide a locking gate latch, which comes in one size that may be used for installation on different size gate posts.

These and additional objects, advantages, features and benefits of the present invention will become apparent from the following specification.

DETAILED DESCRIPTION OF THE PREFERRED EMBODIMENTS

Figure 1:
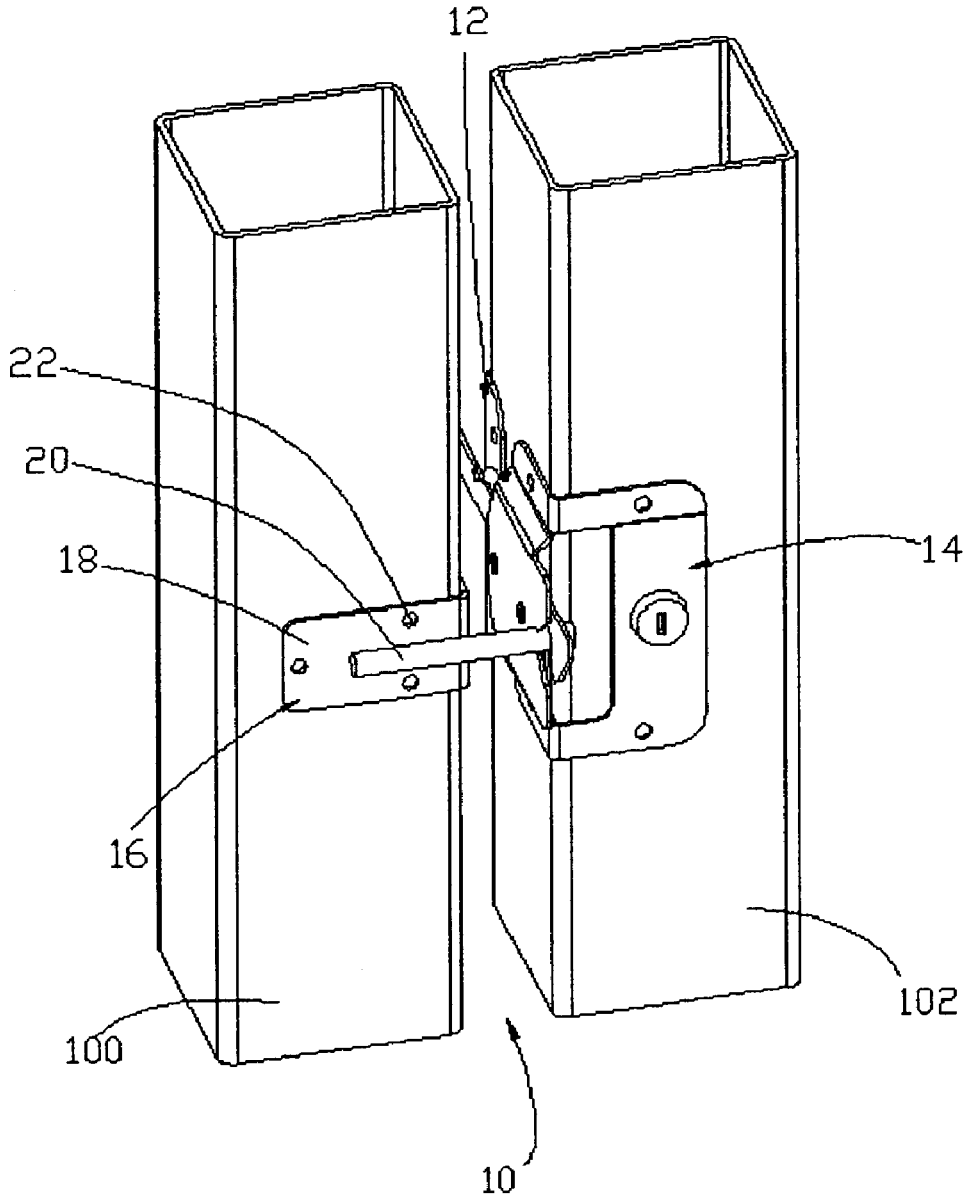
FIG. 1 is a perspective view of a latch assembly and an inside locking assembly installed on a gate post and a striker bar installed on a gate frame of a locking gate latch in accordance with the present invention.
Figure 2:
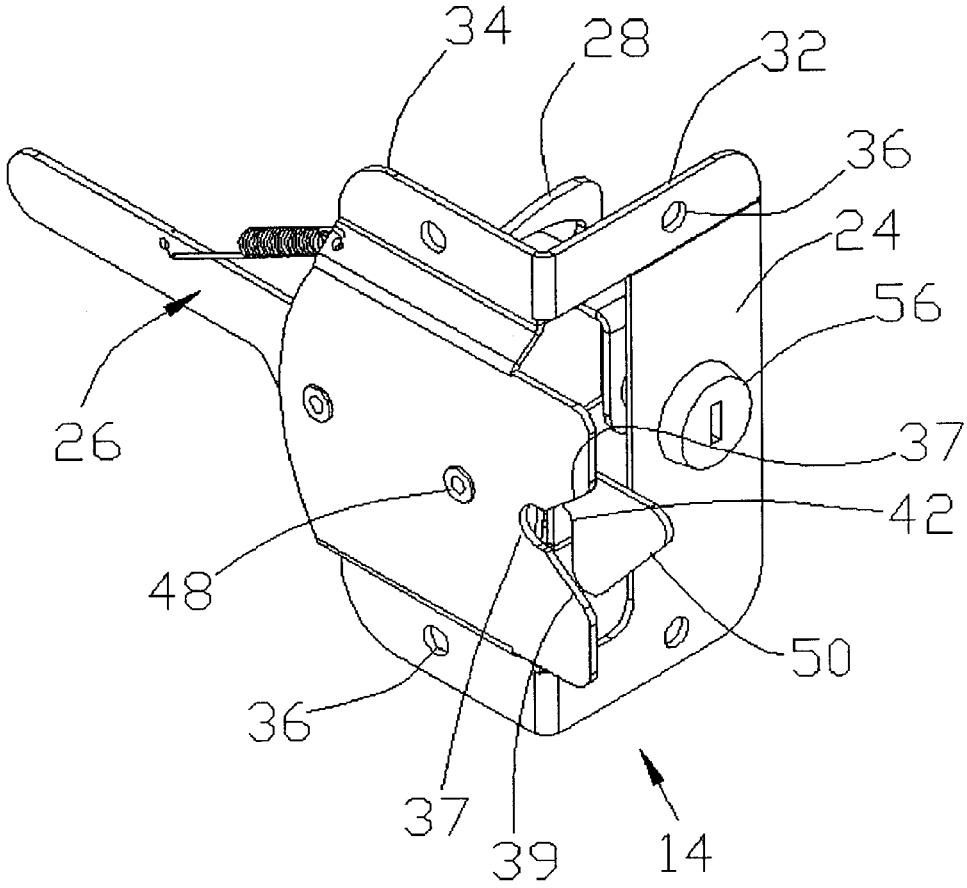
FIG. 2 is an outside perspective view of a latch assembly of a locking gate latch in accordance with the present invention.
Figure 3:
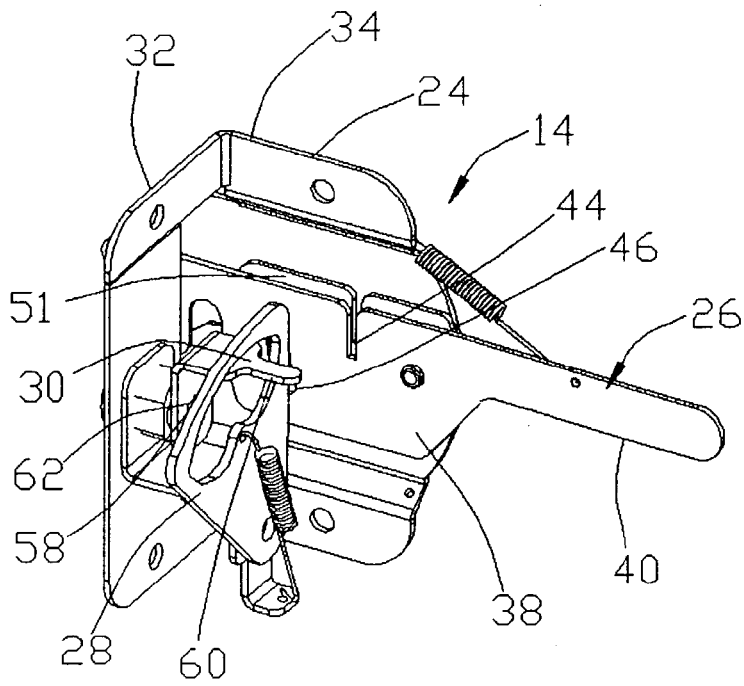
FIG. 3 is an inside perspective view of a latch assembly with a locking plate in a nonlocking position of a locking gate latch in accordance with the present invention.
Figure 4:
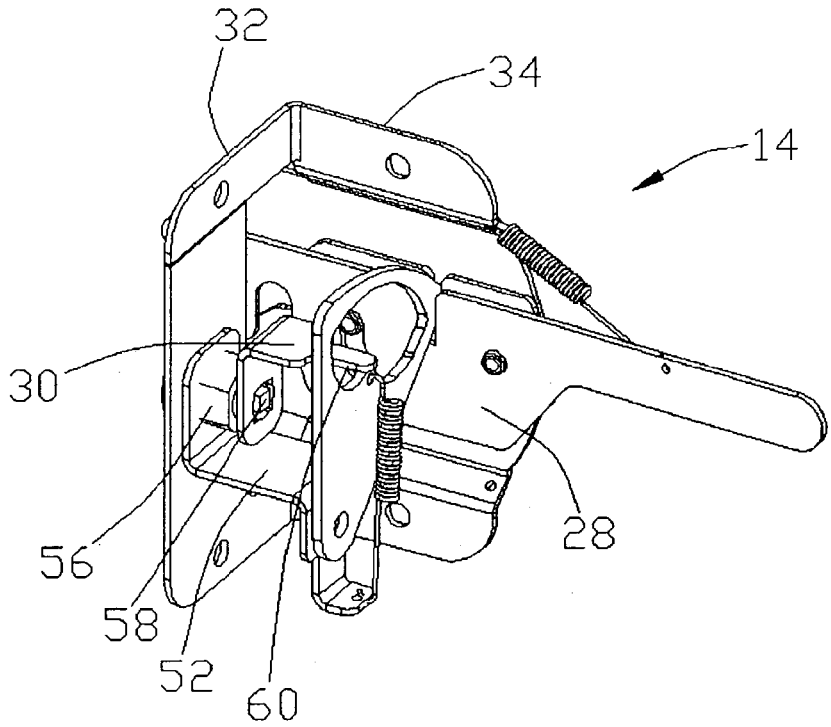
FIG. 4 is an inside perspective view of a latch assembly with a locking plate in a locking position of a locking gate latch in accordance with the present invention.
Figure 5:
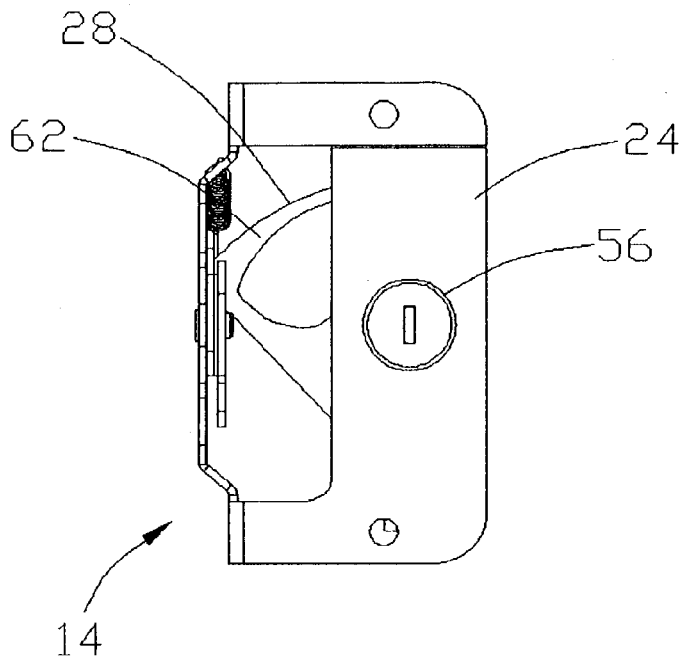
FIG. 5 is a front view of a latch assembly of a locking gate latch in accordance with the present invention.
Figure 6:
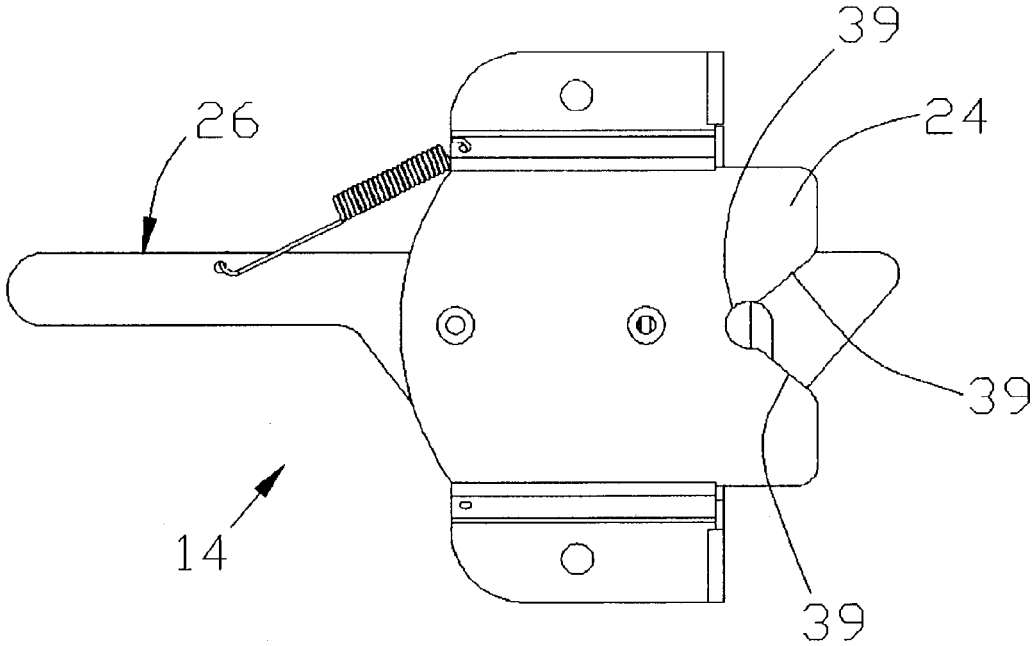
FIG. 6 is a side view of a latch assembly of a locking gate latch in accordance with the present invention.
Figure 7:
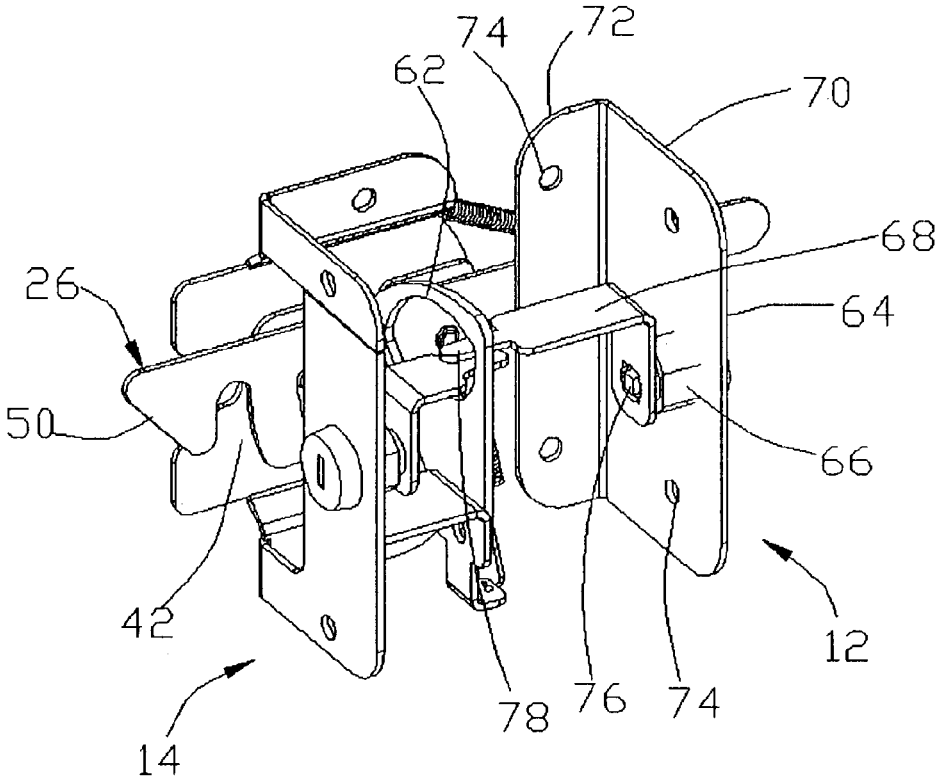
FIG. 7 is a perspective view of an inside locking assembly engaged with a latch assembly of a second embodiment of a locking gate latch in accordance with the present invention.

With reference now to the drawings, and particularly to FIG. 1, there is shown a perspective view of a locking gate latch 10 and an inside locking assembly 12. The gate latch 10 includes a latch assembly 14 and a striker bar 16. The striker bar 16 is attached to a gate frame 100 and the latch assembly 14 is attached to a gate post 102. The striker bar 16 includes a mounting plate 18 and a latch bar 20. The latch bar 20 is preferably attached to the mounting plate 18 by welding, but other attachment methods may also be used. At least two mounting holes 22 are formed through the mounting plate 18 for attachment to the gate frame 100 with fasteners or the like.

With reference to FIGS. 2–7, the latch assembly 14 includes a latch frame 24, a lock latch 26, a locking plate 28 and a locking tongue 30. The latch frame 24 includes a front leg 32 and a side leg 34 extending from one end of the front leg 32. A plurality of mounting holes 36 are formed through the front and side legs to attach the latch frame 24 to the gate post 102 with fasteners or the like. The lock latch 26 is pivotally retained on the side leg 34 of the latch frame 24 with a rivet 27 or the like. A bar retaining slot 37 is formed in one end of the side leg 34 to receive the latch bar 20. Preferably, a pair of lead-in chamfers 39 are formed adjacent, an entrance to the bar retaining slot 37.

The lock latch 26 preferably includes a latch body 38, a handle 40 and a lock bar slot 42. A latch bias spring 43 keeps the lock bar slot 42 adjacent the bar retaining slot 37. One end of the latch bias spring 43 is retained in a handle hole 45 in the handle 40 and the other end of the latch bias spring 43 is retained in a leg hole 47 in the side leg 34. The lock bar slot 42 is formed on one end of the latch body 38 and the handle 40 extends from the other end of the latch body 38. A lock slot 44 is formed in substantially a middle of the lock body 38. The lock slot 44 is sized to receive a thickness of the locking plate 28. A pivot slot 46 is formed adjacent the lock bar slot 42. A limiting fastener 48 preferably extends into the pivot slot 46 to limit the upward pivotally movement of the lock latch 26. A chamfer 50 is preferably formed on the one end of the lock latch 26 to facilitate efficient receipt of the latch bar 20. A latch spacer plate 51 is preferably placed between the lock latch 26 and the side leg 34.

Preferably, one end of an offset member 52 is rigidly attached to an inside of the front leg 32 with any suitable fastening method. The locking plate 28 is pivotally retained by the other end of the offset member 52. A lock spring 49 retains the locking plate 28 in a locked or unlocked position. One end of the lock spring 49 is retained in a lock hole 53 in the locking plate 28 and the other end is retained in an offset hole 55 in the offset member 52. An outside key lock 56 is attached to the front leg 32. Other types of locks may also be used, besides the outside key lock 56. One end of the locking tongue 30 is rigidly attached to a rotating end 58 of the outside key lock 56. A tongue projection 60 is formed on the other end of the locking tongue 30. A projection opening 62 is formed through the locking plate 28 to receive the tongue projection 60. Turning a key in the outside key lock 56 to one side pushes the locking plate 28 into the lock slot 44 and thus locks the latch bar 20 in the lock bar slot 42 and the bar retaining slot 37. Turning the key in the outside key lock 56 to the other side removes the lock plate 28 from the lock slot 44 and thus unlocks the latch bar 20 from in the lock bar slot 42 and the bar retaining slot 37.

Figure 8:
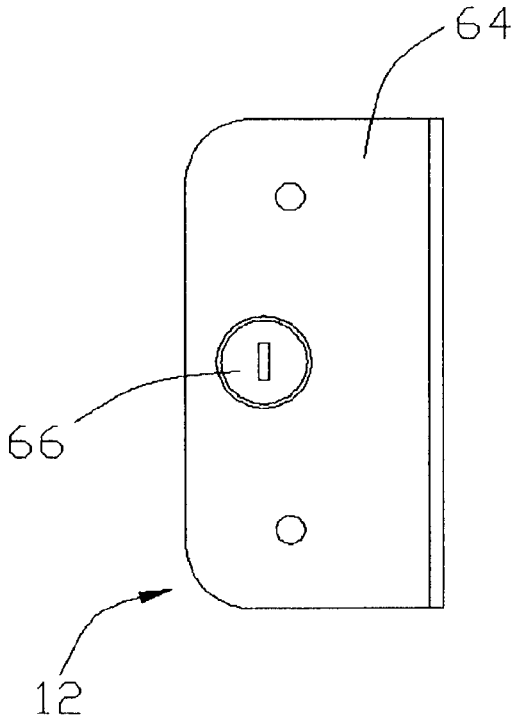
FIG. 8 is a front view of an inside locking assembly of a second embodiment of a locking gate latch in accordance with the present invention.

With reference to FIG. 8, a second embodiment of the locking gate latch further includes an inside locking assembly 12, which allows a gate to be locked from an inside. The inside locking assembly 12 includes a lock frame 64, an inside key lock 66 and an inside locking tongue 68. The lock frame 64 includes an inside front leg 70 and an inside side leg 72 extending from one end of the inside front leg 70. A plurality of inside mounting holes 74 are formed through the inside front leg 70 and the inside side leg 72 to attach the lock frame 70 to the gate post 102 with fasteners or the like. One end of the inside locking tongue 68 is rigidly attached to a rotating end 76 of the inside key lock 66. Other types of locks may also be used, besides the inside key lock 66.

An inside tongue projection 78 is formed on the other end of the inside locking tongue 68. The projection opening 62 is sized to receive the inside tongue projection 78. The inside locking assembly 12 may be fabricated to fit on numerous sizes of gate posts. A length of the inside tongue projection 78 is increased to work with the largest size gate post. A plurality of score marks are formed on a length of the inside tongue projection 78. The plurality of score marks allow the length of the inside tongue projection 78 to be decreased by breaking off a portion thereof to fit a particular size of gate post.

Turning a key in the inside key lock 66 to one side pushes the locking plate 28 into the lock slot 44 and thus locks the latch bar 20 in the lock bar slot 42 and the bar retaining slot 37. Turning the key in the inside key lock 66 to the other side removes the locking plate 28 from the lock slot 44 and thus unlocks the latch bar 20 from in the lock bar slot 42 and the bar retaining slot 37.

Figure 9:
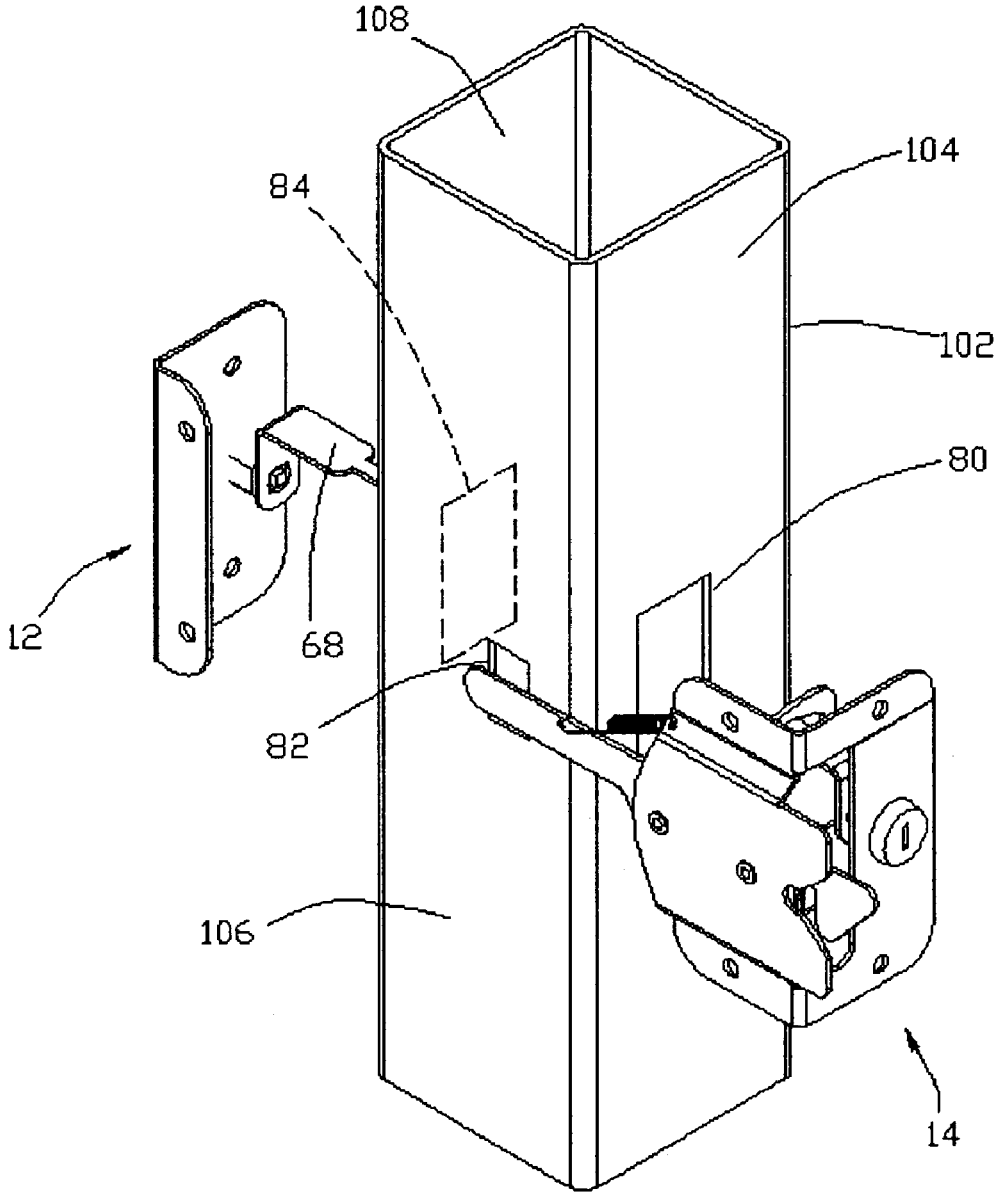
FIG. 9 is an exploded perspective view of a latch assembly, inside locking assembly and gate post in accordance with the present invention.

With reference to FIG. 9, the locking gate latch 10 is preferably installed in the following manner. The gate post 102 must be of rectangular tubular construction for installation of the latch assembly 14. An outside lock opening 80 is formed through a front wall 104 of the gate post 102 to receive the locking tongue 30. A locking plate opening 82 is formed through a side wall 106 of the gate post 102 to receive the locking plate 28. At least two fasteners are used to attach the latch assembly 14 to the gate post 102. An inside lock opening 84 is formed through a rear wall 108 of the gate post 102 to receive the inside locking tongue 68. At least two fasteners are used to attach the inside locking assembly 12 to the gate post 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A locking gate latch comprising:

a striker bar;

a latch frame including a first leg and a second leg;

a lock latch being pivotally retained by said second leg, one end of said lock latch being capable of receiving said striker bar, a bar retaining slot being formed in one end of said second leg to receive said striker bar;

a locking plate being pivotally retained by said first leg, said locking plate being engagable with said lock latch;

a lock being retained in said first leg, wherein pivoting said lock causing said locking plate to be engagable with said lock latch.

2. The locking gate latch of claim 1, further comprising:

a locking tongue being attached to a rotating end of said lock, a projection opening being formed in a top of said locking plate, said projection opening receiving an end of said locking tongue.

3. The locking gate latch of claim 1, further comprising:

an offset member being attached to an inside of said first leg, said locking plate being pivotally retained by the other end of said offset member.

4. The locking gate latch of claim 1 wherein:

a lock slot being formed in said lock latch to receive said locking plate.

5. The locking gate latch of claim 2, further comprising:

an inside locking assembly including an inside lock, one end of an inside locking tongue being attached to a rotating end of said inside lock, the other end of said inside locking tongue being received by said projection opening.

6. A locking gate latch in combination with a gate frame and a gate post, comprising:

a striker bar being attached to said gate frame;

a latch frame being attached to said gate post, said latch frame including a first leg and a second leg;

a lock latch being pivotally retained by said second leg, a lock bar slot being formed on one end of said lock latch to receive said striker bar;

a locking plate being pivotally retained on said first leg, a lock slot being formed in said lock latch to receive said locking plate;

a lock being retained in said first leg, wherein pivoting said lock causing said locking plate to be inserted into said lock slot.

7. The locking gate latch in combination with a gate frame and a gate post of claim 6, further comprising:

a locking tongue being attached to a rotating end of said lock, a projection opening being formed in a top of said locking plate, said projection opening receiving an end of said locking tongue.

8. The locking gate latch in combination with a gate frame and a gate post of claim 6 wherein:

a bar retaining slot being formed in one end of said second leg to receive said striker bar.

9. The locking gate latch in combination with a gate frame and a gate post of claim 6, further comprising:

an offset member being attached to an inside of said first leg, said locking plate being pivotally retained by the other end of said offset member.

10. The locking gate latch in combination with a gate frame and a gate post of claim 6, further comprising:

an inside locking assembly including an inside lock, one end of an inside locking tongue being attached to a rotating end of said inside lock, the other end of said inside locking tongue being received by said projection opening.

11. The locking gate latch in combination with a gate frame and a gate post of claim 6 wherein:

said gate post having a tubular cross section.

12. A locking gate latch in combination with a gate frame and a gate post, comprising:

a striker bar being attached to said gate frame;

a latch assembly being attached to a front of said gate post, said assembly including a lock latch and a locking plate, said lock latch being pivotally retained on a side of said latch assembly, one end of said lock latch receiving said striker bar, said locking plate being pivotally retained on a front of said latch assembly, said locking plate being engagable with said lock latch, wherein pivoting said lock causing said locking plate to engage said lock latch; and an inside locking assembly being attached to a rear of said gate post, said inside locking assembly enabling a gate to be locked from an inside thereof.

13. The locking gate latch in combination with a gate frame and a gate post of claim 12, comprising:

a locking tongue being attached to a rotating end of said lock, a projection opening being formed in a top of said locking plate, said projection opening receiving an end of said locking tongue.

14. The locking gate latch in combination with a gate frame and a gate post of claim 12 wherein:

a bar retaining slot being formed in one end of said second leg to receive said striker bar.

15. The locking gate latch in combination with a gate frame and a gate post of claim 12 wherein:

a lock slot being formed in said lock latch to receive said locking plate.

16. The locking gate latch in combination with a gate frame and a gate post of claim 12, further comprising:

an offset member being attached to an inside of said first leg, said locking plate being pivotally retained by the other end of said offset member.

17. The locking gate latch in combination with a gate frame and a gate post of claim 12, further comprising:

said inside locking assembly including an inside lock, one end of an inside locking tongue being attached to a rotating end of said inside lock, the other end of said inside locking tongue being received by said projection opening.

18. The locking gate latch in combination with a gate frame and a gate post of claim 12, further comprising:

said gate post having a tubular cross section.

* * * * *